US012733713B2

(12) United States Patent
Kobayashi et al.

(10) Patent No.: US 12,733,713 B2
(45) Date of Patent: Sep. 15, 2026

(54) ANATOMICALLY PLIANT ATHLETIC FOOTWEAR

(71) Applicant: James Yoshitatsu Kobayashi, Alamo, CA (US)

(72) Inventors: James Yoshitatsu Kobayashi, Alamo, CA (US); Geraldine Shizuko Kobayashi, Alamo, CA (US); Alexander Giichi Kobayashi, Alamo, CA (US); J'aime Marie Kimiko Hills, Chula Vista, CA (US)

(73) Assignee: James Yoshitatsu Kobayashi, Alamo, CA (US)

( * ) Notice: Subject to any disclaimer, the term of this patent is extended or adjusted under 35 U.S.C. 154(b) by 26 days.

(21) Appl. No.: 18/300,138

(22) Filed: Apr. 13, 2023

(65) Prior Publication Data

US 2023/0337785 A1 Oct. 26, 2023

Related U.S. Application Data

(60) Provisional application No. 63/333,926, filed on Apr. 22, 2022.

(51) Int. Cl.

| | |
|---|---|
| ***A43B 13/20*** | (2006.01) |
| ***A43B 13/12*** | (2006.01) |
| ***A43B 17/16*** | (2006.01) |

(52) U.S. Cl.

CPC ..... *A43B 13/20* (2013.01); *A43B 13/122* (2013.01); *A43B 17/16* (2013.01)

(58) Field of Classification Search

CPC ..... A43B 7/144; A43B 7/1425; A43B 7/1405; A43B 7/143; A43B 13/148; A43B 13/122;

(Continued)

(56) References Cited

U.S. PATENT DOCUMENTS 4,727,660 A * 3/1988 Bernhard ..... A43B 7/144 36/110
4,813,162 A * 3/1989 Harris ..... A43B 7/141 36/43

(Continued)

FOREIGN PATENT DOCUMENTS

JP 2016-059555 A 4/2016
KR 10-0890529 B1 3/2009

(Continued)

OTHER PUBLICATIONS

International Search Report and Written Opinion issued in application No. PCT/US2023/019487 on Aug. 7, 2023.

*Primary Examiner* — Alissa J Tompkins
*Assistant Examiner* — Catherine M Ferreira
(74) *Attorney, Agent, or Firm* — Knobbe, Martens, Olson & Bear, LLP

(57) ABSTRACT

An anatomically pliant athletic shoe comprising soles, wherein the soles have a bottom surface, a top surface, and a junction point, a toe box connecting to the top surface of the soles and protruding from the top surface of the sole, a toe post protruding from the top surface of the soles toward the toe box running parallel to the soles, a first end of a toe strap protruding from a first attachment point on the top surface toward the toe box running parallel to the soles, running alongside the toe box and connecting a second end of the toe strap to a second attachment point on the top surface of the soles, an angled section of the soles, connecting the top surface and the bottom surface, wherein the angled section connects a top surface that is larger than a bottom surface, and a compressible area of the soles.

20 Claims, 19 Drawing Sheets

(58) Field of Classification Search
CPC ..... A43B 7/24; A43B 7/26; A43B 13/186; A43B 13/20; A43B 17/16
USPC ..... 36/29
See application file for complete search history.

(56) References Cited

U.S. PATENT DOCUMENTS

| | | | | |
|---|---|---|---|---|
| 5,224,810 | A * | 7/1993 | Pitkin | A43B 13/14 36/25 R |
| 5,632,104 | A * | 5/1997 | Zohar | A43B 7/14 36/94 |
| 7,712,231 | B2 * | 5/2010 | Umezawa | A43B 13/125 36/144 |
| 10,856,614 | B2 * | 12/2020 | Markison | A43B 23/0215 |
| 10,952,493 | B1 * | 3/2021 | Downard | A43B 7/1435 |
| 2010/0263234 | A1 * | 10/2010 | Teteriatnikov | A43B 13/145 36/108 |
| 2014/0373391 | A1 * | 12/2014 | Heid | A61F 5/019 36/89 |
| 2015/0374094 | A1 * | 12/2015 | Gift | A43B 23/081 36/94 |
| 2016/0242498 | A1 * | 8/2016 | Sakamoto | A43B 13/122 |
| 2018/0255870 | A1 * | 9/2018 | Oda | A43B 7/1415 |
| 2019/0289956 | A1 | 9/2019 | Eugene | |

FOREIGN PATENT DOCUMENTS

| | | | |
|---|---|---|---|
| WO | WO 01/72161 | A1 | 10/2001 |
| WO | WO 2010/125862 | A1 | 11/2010 |

* cited by examiner

100

100

100

1200

1200

1200

1800

ANATOMICALLY PLIANT ATHLETIC FOOTWEAR

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

This disclosure relates generally to footwear and, more specifically, to athletic performance footwear.

SUMMARY

When forces are not directed in a straight line from the hip to the foot or from the foot to the hip, the ligaments, tendons, meniscus, and muscles can be stretched, twisted, and even torn. Injuries can range from subclinical to severe. Rolling of the ankle is an example of a common injury that can range from minor to severe. Severe injuries include grade 2 and grade 3 sprains, tears, and ruptures. When the traction of the shoe's outsole exceeds the strength of the ankle, the foot continues to move laterally until it rotates around the outer edge of the shoe resulting in rolling of the ankle. If the traction of the shoe's outsole is insufficient to prevent lateral slide, the lower extremities may continue to move laterally, possibly causing injury to the muscles, ligaments, and tendons of the lower extremities.

Existing athletic footwear directs forces in a straight line from the foot to the hip when standing vertically, moving straight forward or straight backward; however, in other directions, forces may not be directed in a straight vector from the foot to the hip.

Certain aspects of the present disclosure are related to footwear configured to direct forces physiologically up and down the lower extremities in the forward, backward and lateral directions. This is accomplished by permitting the anatomy of the lower extremities to dictate the way the footwear functions, rather than the design of the footwear dictating the manner in which the lower extremities function.

DETAILED DESCRIPTION

Athletic shoes are designed to help athletes perform at an optimal level. For athletes to perform at an optimal level, their equipment must aid in their movement and prevent injuries. There exists a need to prevent athletic injuries by using footwear that is anatomically pliant, that is that the footwear will promote natural movement of the ankle and prevent movement that can damage the internal structure of the ankle and lower extremities.

Figure 1:
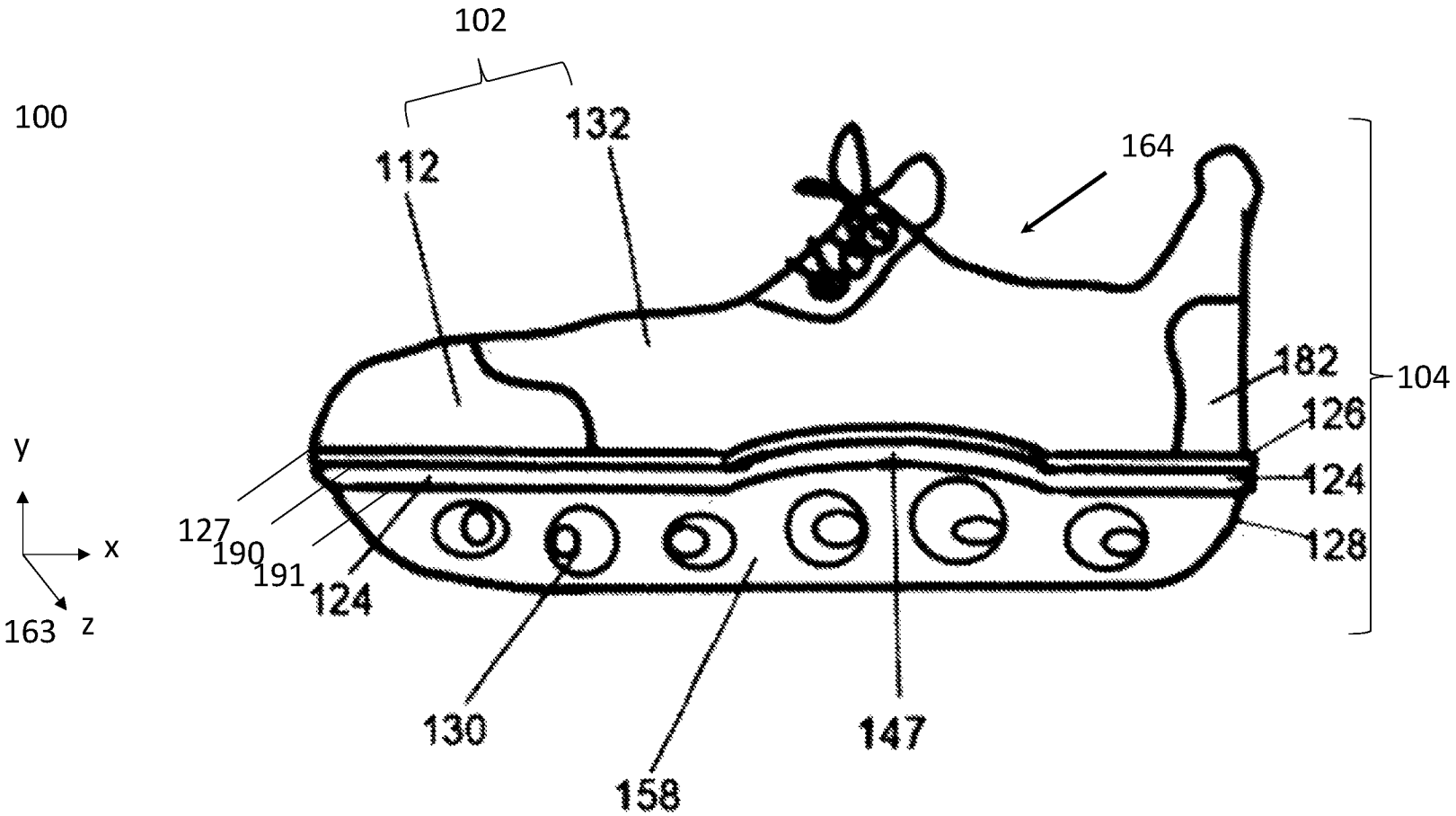
FIG. 1 is an illustration of a medial view of a right anatomically pliant athletic shoe.

FIG. 1 is an illustration of a medial view of a right anatomically pliant athletic shoe 100. The anatomically pliant athletic shoe 100 includes a toe box 112 and vamp 132, which together create a top covering 102 (e.g., an upper). The top covering 102 to a sole, which may comprise one or more layers of soles. For example, in the illustrated embodiment, the top covering connects to an insole 126 to encapsulate the foot 164 of the wearer, where the top covering 102 is shaped to wrap around the top of the foot 164 of the wearer, and the insole 126 acts as a barrier between the sole of the foot 164 of the wearer and the ground (not pictured). The toe box 112 protrudes from the insole 126 in the y-direction and then curves to run generally perpendicularly in the x-direction to the insole 126 before connecting to the vamp 132. The insole 126 is connected on an insole bottom face 190 of the insole 126 to a midsole 124, the midsole adding further support and protection to the sole of the foot 164 of the wearer. In some embodiments, as depicted, an outsole 128 is connected as an additional layer of protection, connecting to a midsole bottom face 191 of the midsole 124. The outsole 128 can have an angled portion 158 (as better shown in FIG. 3, for example) along a medial side 163 in the z-direction of the anatomically pliant athletic shoe and treads 130 that extend along the outsole 128. The insole 126, midsole 124, and/or outsole 128 can include an arch 147 to provide support to the arch of the foot 164 of the wearer. Additional support can be added by a heel counter 182 that connects to a top face 127 of the insole 126 and along a heel edge 104 of the top covering 102. When the outsole 128, midsole 124, and insole 126 are referred to as a unit they will be referred to as the soles 129. The vamp 132 may include varying amounts of ankle coverage including, but not limited to, both low tops and high tops. Additionally, while laces are pictured, other shoe fasteners such as hook and loop, snaps, buttons, zippers, straps, with hook and loop fasteners, straps with buckles, buckles, or elastic stretch closures or any combination thereof can be used.

Figure 2:
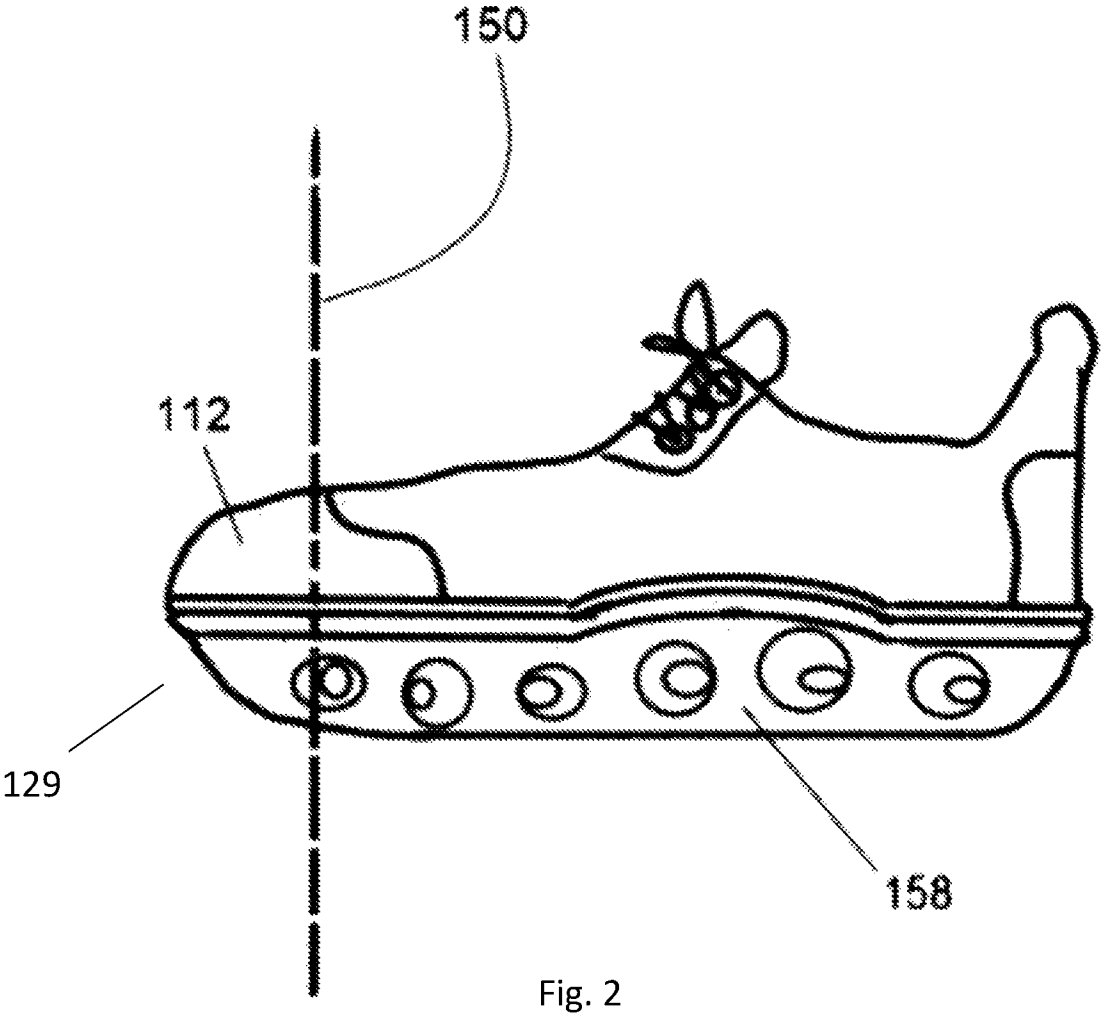
FIG. 2 is an illustration of a medial view of a right anatomically pliant athletic shoe indicating the location of a toe post cross section.
Figure 10:
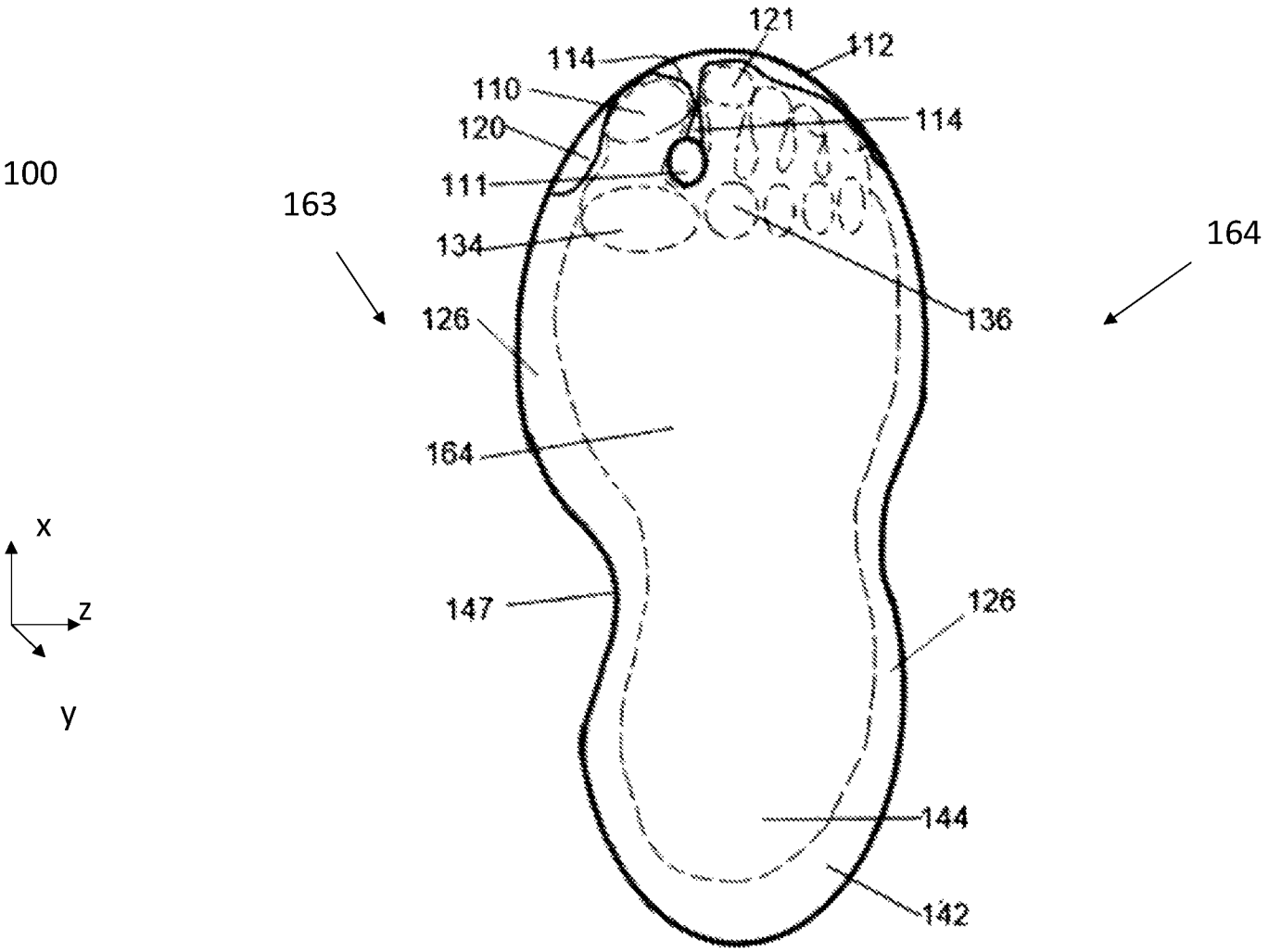
FIG. 10 is an illustration of a top view of an insole of a right anatomically pliant athletic shoe.

FIG. 2 is an illustration of a medial view of a right anatomically pliant athletic shoe 100 indicating the location of a toe post cross section 150. A toe post cross section 150 indicates a location within a cavity 106 created between the soles 129 and the toe box 112. The toe post cross section 150 is a location within the anatomically pliant athletic shoe 100 at which an anchor point, or a toe post 111 as seen in FIG. 10, can be situated to decrease unnatural and potentially harmful lateral movements of an ankle, foot, and lower extremities.

Figure 3:
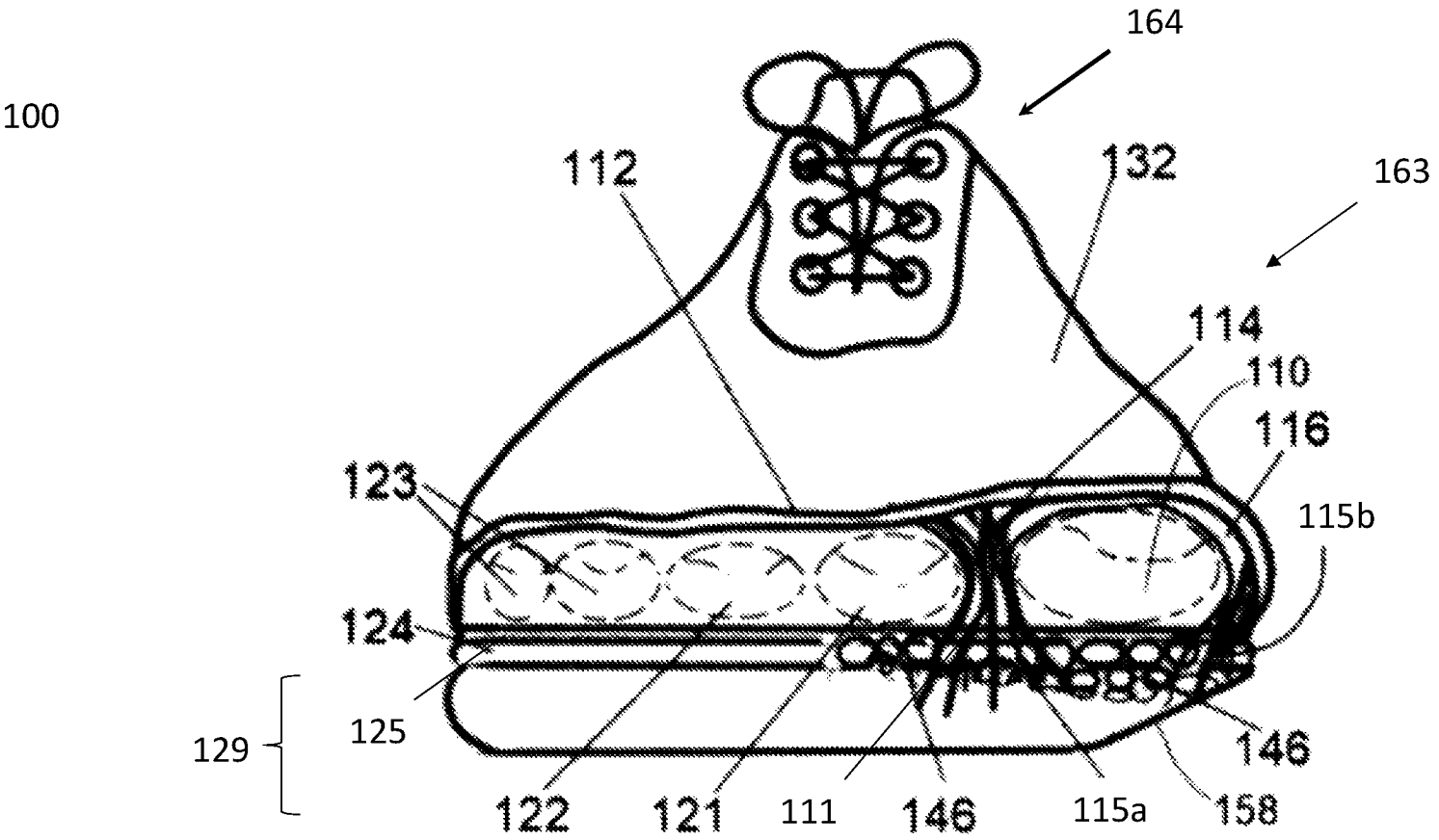
FIG. 3 is an illustration of a frontal cross-sectional view of an anatomically pliant athletic shoe through the toe box.

FIG. 3 is an illustration of a frontal cross-sectional view of an anatomically pliant athletic shoe 100 through the toe box 112 (e.g., along the toe post cross section 150 line of FIG. 2). As illustrated in FIG. 3, within the anatomically pliant athletic shoe 100 is an outline of a foot 164 including a hallux 110 (big toe), second toe 121, third toe 122, and other toes 123. The hallux box 116 includes a toe post 111 (also shown and described with reference to FIG. 10), and the toe strap 114. In the illustrated embodiment, the toe post 111 protrudes from a top surface 125 of the soles 129 toward the toe box 112 where the toe box 112 runs parallel to the soles 129. The toe post 111 can be positioned on the soles such that, when the shoe 100 is worn, the top post 111 extends up between the hallux 110 and the second toe 121.

As shown in the illustrated embodiment, the toe strap 114 can attach at a first attachment point 115*a* to the top surface 125 of the soles 129 and extends perpendicularly from the soles 129 toward the toe box 112 between the hallux 110 and the second toe 121 to securely imbed and integrate into an inner lining of the toe box 112. The embedded toe strap 114 can be configured and positioned to circumscribe the hallux 110 and can run parallel to the top surface 125 of the soles 129 before it returns to the soles 129 and is inserted into the soles 129 at a second attachment point 115*b*.

The toe post 111 can be a semi-rigid, non-irritating, circular or ovoid column at the vertex of the space between the hallux 110 and the second toe 121. The toe post 111 can be attached to the soles 129 and connects to the toe box 112.

In some embodiments, the soles 129 can further include a compressible area 146. The compressible area 146 in the soles 129 can extend under the hallux 110 and second toe 121 to a midway point 119 and is more compressible than the other portions of the soles 129. The compressible area 146 is shown with an example embodiment indicated by circles, however, the compressible area 146 of the soles 129 can be any shape, cellular structure, architectural design, and may be created from any compressible materials or structures. The compressible area 146 is a region of the soles 129 that is less dense than the other areas of the soles 129 such that the compressible region more easily compresses than the other areas of the soles when pressure is exerted on the soles 129, such as when a wearer takes a side step. The schematic drawings illustrating the relationship of the featured parts are not proportional but used to exemplify the embodiments and their interaction.

The toe strap 114 can comprise various materials such as natural fibers, or synthetic materials, both pliable and molded, such that it can be securely attached to the soles 129 and toe box 112, supporting the forces of the foot 164 during function, is non-irritating, and is comfortable. The toe strap 114 can be securely attached to the soles 129 between the hallux 110 and second toe 121. It can occupy the inter-toe space where the toe post 111 is attached and is securely attached to the toe box 112 superiorly. The toe strap 114 can be securely attached to the toe post 111 and continues between said toes to wrap around the hallux 110 and embeds into soles 129 on a side of the hallux 110 opposite the toe post 111. The toe strap 114 can circumscribe the hallux 110 to attach to the soles 129. The angled section 158 of the outsole 128 can allow greater stability and force generated by the body core by allowing the muscles of the foot and legs to brace more securely, thus allowing the torso to rotate more forcefully.

Figure 4:
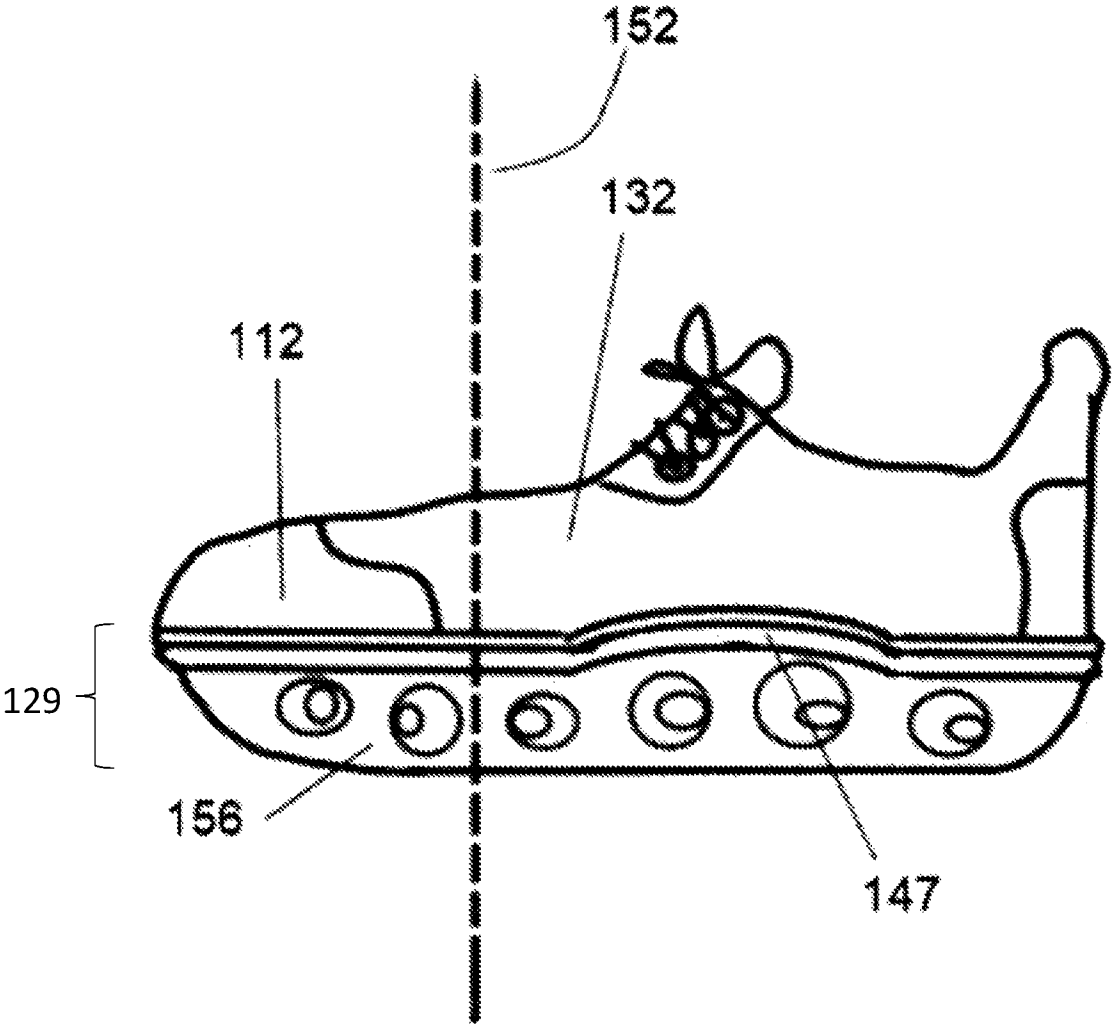
FIG. 4 is an illustration of a medial view of a right anatomically pliant athletic shoe with a vamp cross section.

FIG. 4 is an illustration of a medial view of a right anatomically pliant athletic shoe 100 with a vamp cross section 152. FIG. 4 is similar in most respects to the illustrated anatomically pliant athletic shoe but with a vamp cross section 152 indicating the location of the cross section through the vamp 132 which can also delineate the difference between the compressible area 146 of FIG. 3 and the rest of the soles 129 in at least one direction.

Figure 5:
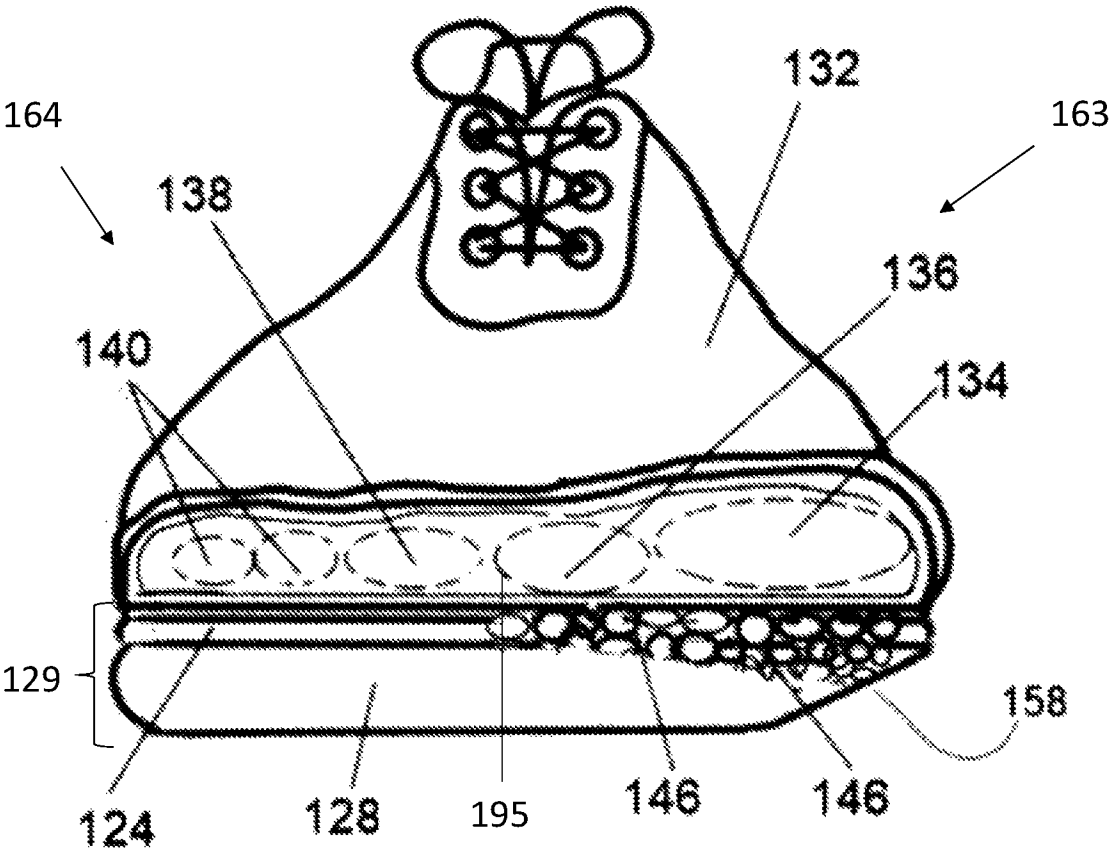
FIG. 5 is an illustration of a cross-sectional view through the metatarsal section of an anatomically pliant athletic shoe.

FIG. 5 is an illustration of a cross-sectional view through the metatarsal section of an anatomically pliant athletic shoe 100. The vamp cross section 152 of FIG. 4 indicates a location within the anatomically pliant athletic shoe 100 where the compressible area 146 begins and continues through the soles 129 at the vamp 132 and ends at a medial section 195. The compressible area 146 extends across the soles 129 to rest underneath the first 134 and second 136 metatarsal bones. The compressible area 146 can extend to cover anywhere from 30%-40% of the soles 129. In some embodiments, the compressible area 146 extends deeper into the soles 129 under the hallux 110 and the area under the first 134 and second metatarsal bones 136. In some embodiments, the soles 129 include an angled section 158 under the hallux 110 and the compressed area 146. In some embodiments the angle can create an angle with the ground from which can be 5°, 10°, 15°, 20°, 25°, 30°, 35°, 40°, 45°, 50°, 55°, 60°, 65°, 70°, 75°, 80°, 85°, or 90°, or in a range between any two angles. In some embodiments, the compressible area 146 is calculated by using the size of the hallux 110 and the second toe in comparison to the width of the foot.

Figure 6:
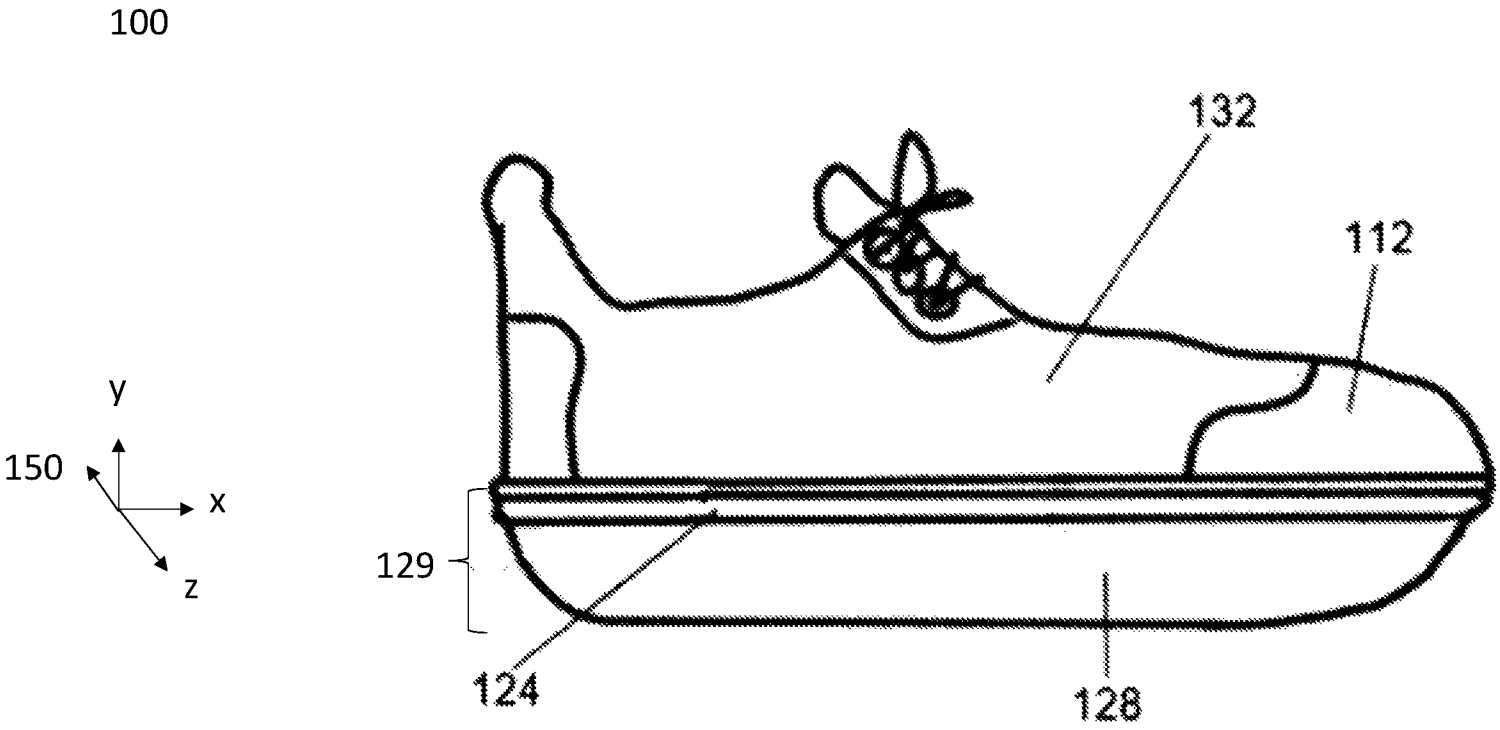
FIG. 6 is an illustration of a lateral view of a right anatomically pliant athletic shoe.

FIG. 6 is an illustration of a lateral view of a right anatomically pliant athletic shoe 100. In some examples, the external side 150 in the z-direction of the sole 129 including the outsole 128 and the insole 126 of the anatomically pliant athletic shoe 100 does not include the compressible area 146 or the angled section 158 of FIG. 5.

Figure 7:
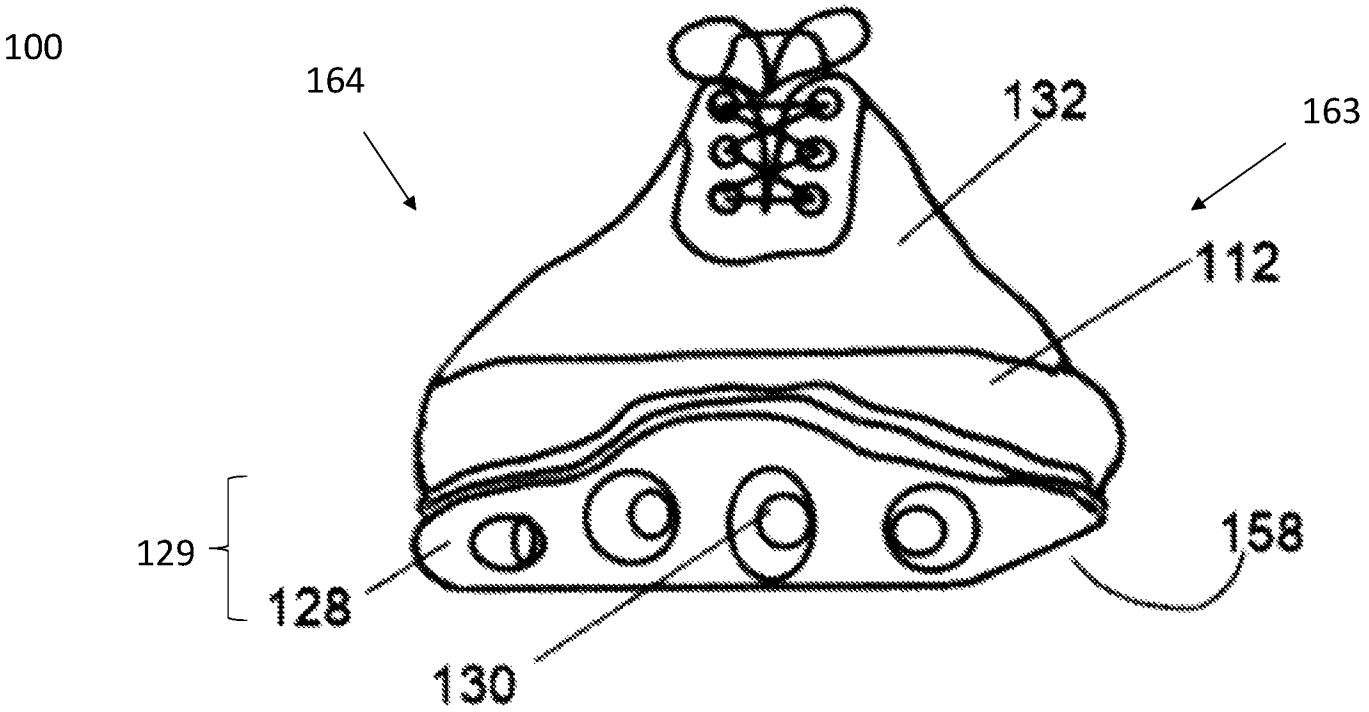
FIG. 7 is an illustration of a frontal view of a right anatomically pliant athletic shoe.

FIG. 7 is an illustration of a frontal view of a right anatomically pliant athletic shoe 100. FIG. 7 depicts the treads 130 within the outsole 128 and the angled section 158 running along the medial side 163 of the anatomically pliant athletic footwear 100.

Figure 8:
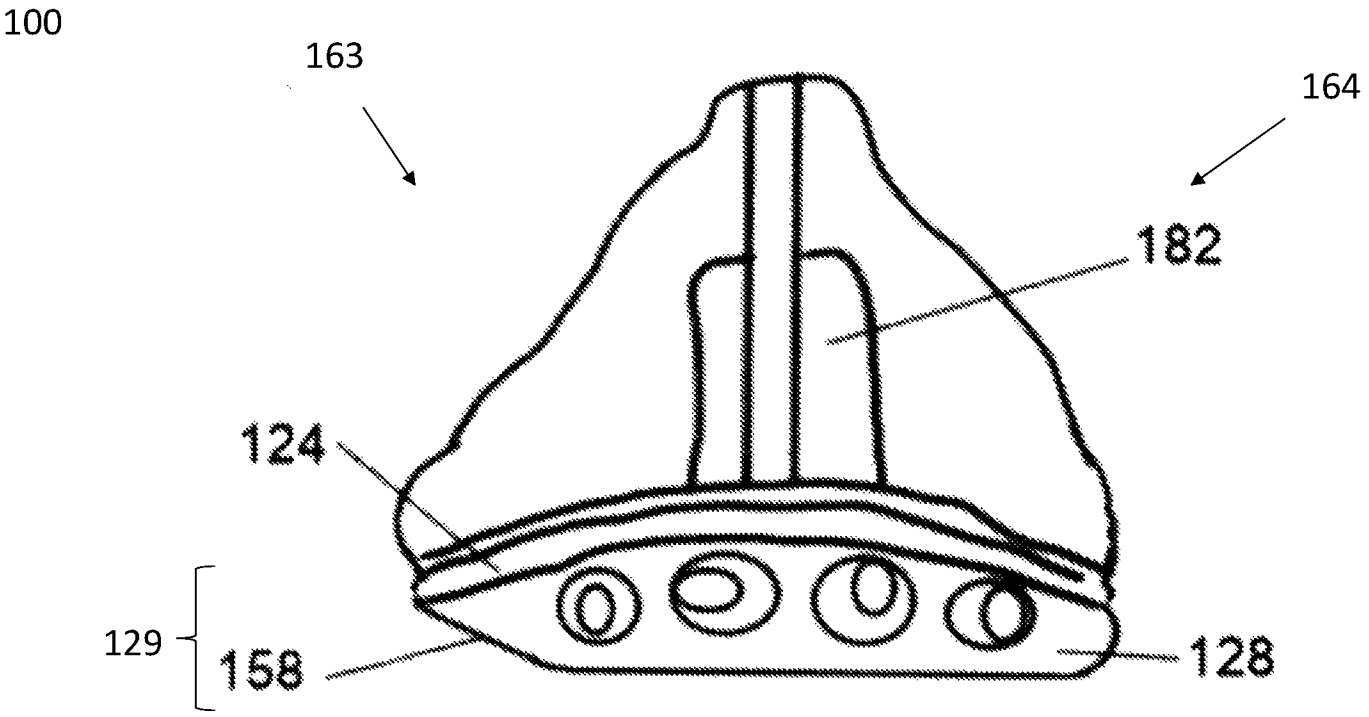
FIG. 8 is an illustration of a posterior view of a right anatomically pliant athletic shoe.

FIG. 8 is an illustration of a posterior view of a right anatomically pliant athletic shoe 100. In some embodiments, the angled section 158 of the outsole 128 extends from the toe box 112 as seen, for example, in FIG. 7, through to the soles 129 where they connect to the heel counter 182. For example, the angled section 158 can extend along the entire medial side of the shoe 100. In some embodiments, the angled section 158 extends along only a portion of the medial side of the shoe 100, for example, along 50%, 60%, 70%, 75%, 80%, or 90% of the length of the medial side of the shoe. In some embodiments, The angled section 158 can be positioned under at least the forefoot (e.g., on the medial side of the shoe).

Figure 9:
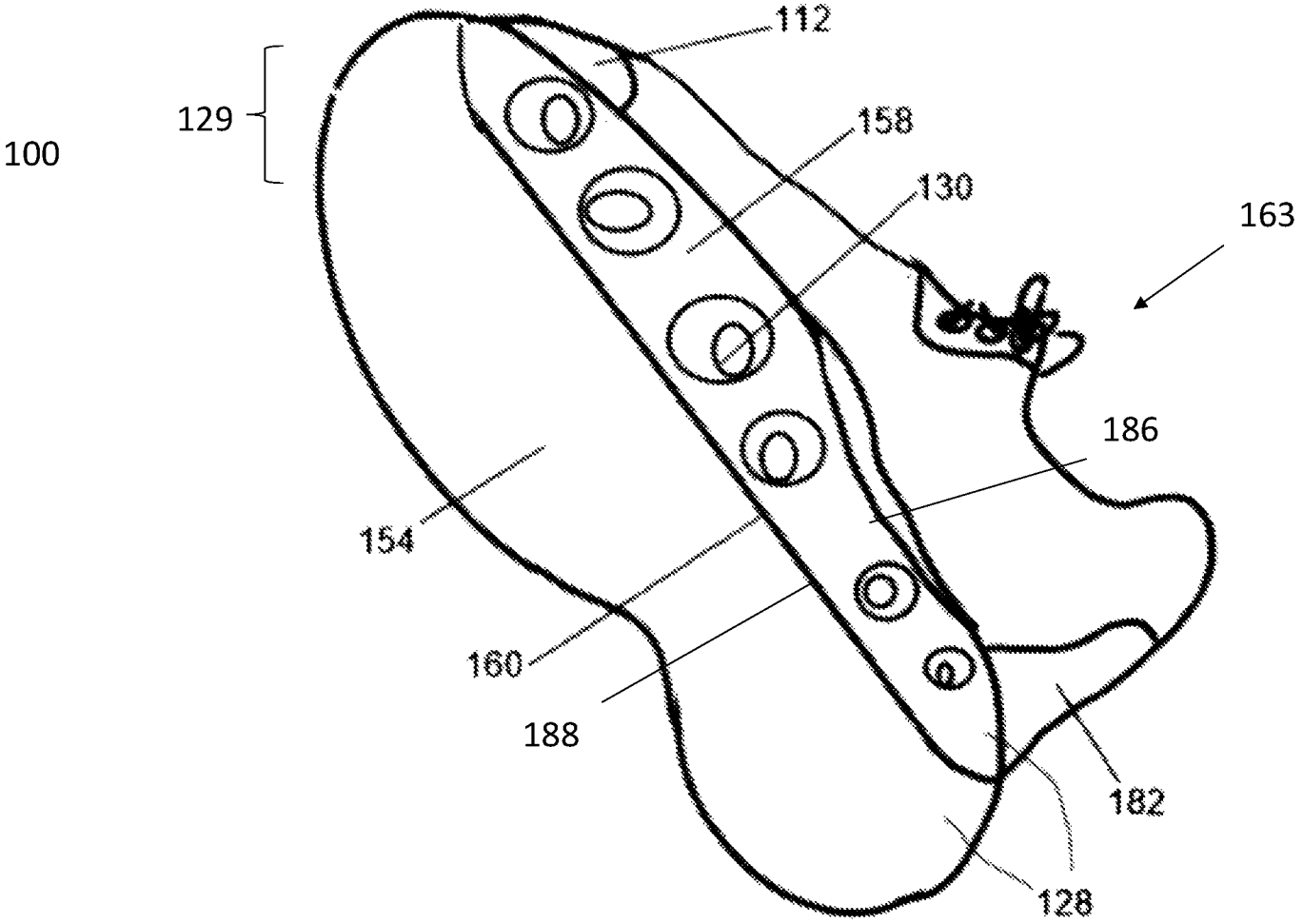
FIG. 9 is an illustration of a perspective view of a right anatomically pliant athletic shoe.

FIG. 9 is an illustration of a perspective view of a right anatomically pliant athletic shoe 100 with the medial side 163 of the right anatomically pliant athletic shoe 100 including the outsole 128 and bottom surface 154. The angled section 158 connects a first edge 186 to the top surface 125 of the soles 129 and extends to the bottom surface 154 of the soles 129 to connect a second edge 188 to the bottom surface 154 of the soles 129 at a junction 160. The top surface 125 of the soles 129 is larger than the bottom surface 154 of the soles 129 causing the angled section 158 to angle from the top surface 125 to the bottom surface 154. In some embodiments, the angled section 158 of the outsole 128 and the bottom surface 154 section of the outsole 128 meet at a junction 160. The junction 160 can be the point or line where the angled section 158 of the outsole 128 ends along the bottom surface 154 of the outsole 128. The bottom surface 154 of the outsole 128 is, in some embodiments, smaller than a lateral side 165 of the outsole 128 which attaches to the midsole 124 and the insole 126. In some embodiments, the outsole 128 at the bottom surface 154 can include tread, cleats, and/or spikes for different athletic uses.

The outsole 128 can further include a compressible area 146 that can be constructed of natural materials, synthetic materials, fabricated or engineered material such that the soles 129 under the hallux 110, second toe 121, first metatarsal 134 and second metatarsal 136 are more compressible than the rest of the soles 129. The performance shoe can be manufactured with an angled section 158 of the outsole 128, the angle will vary depending on the thickness of the sole 129 of the anatomically pliant athletic shoe 100 and the width of the foot 164 it supports; the position of the junction 160 of the angled section 158 and the bottom section 154 will be located such that the foot 164 is stable in forward, backward, and lateral movements.

FIG. 10 is an illustration of a top view of an insole 126 of a right anatomically pliant athletic shoe 100. Within the soles 129 resides an indication of an example foot 164 in relation to the soles 129. The hallux 110 of the foot 164 rests along the toe box 112 situated in the x direction from the hallux 110, toe post 111 situated in the z direction from the hallux 110, and toe strap 114 which attaches to the soles 129 at the toe post 111 and extends in the y direction and then crosses over the hallux 110 to attach to the soles 129 at a secondary location in the −z direction of the hallux 110, thus encapsulating the hallux 110 between the toe strap 114 in the y direction and the soles 129 in the −y direction.

Figure 11:
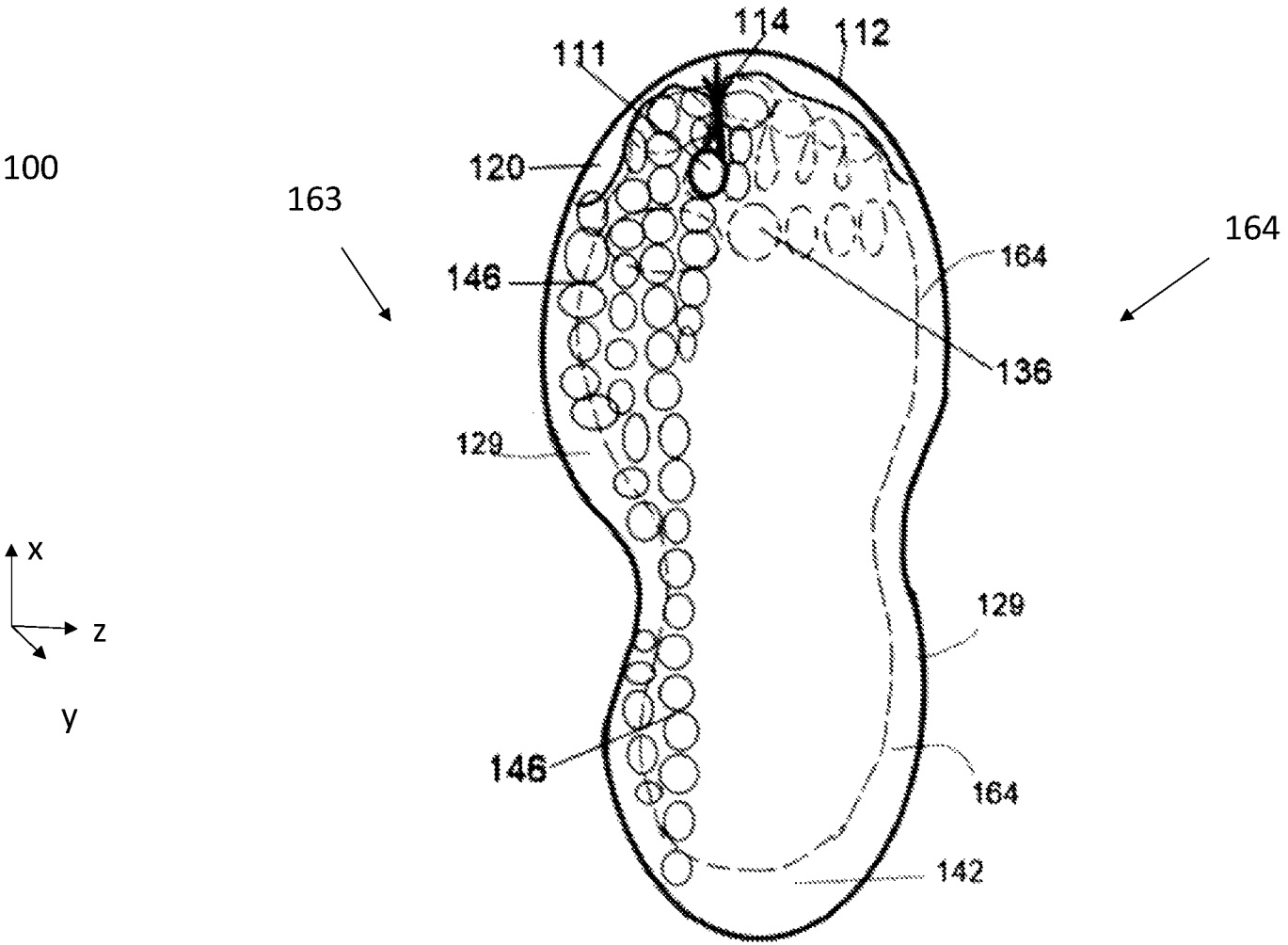
FIG. 11 is an illustration of a top view of a compressible layer of an insole of an anatomically pliant athletic shoe.

FIG. 11 is an illustration of a top view of a compressible area 146 of an insole 126 of an anatomically pliant athletic shoe 100. Within the anatomically pliant athletic shoe 100 is a foot 164 in relation to the soles 129. The compressible area 146 of the insole 126 rests under the hallux 110. The compressible area 146 extends from the −z limit of the soles 129 under the foot 164 and stops at a location near the toe post 111. The compressible area 146, within that limitation runs from the x limit of the soles 129 to the −x limit of the soles 129.

Figure 12:
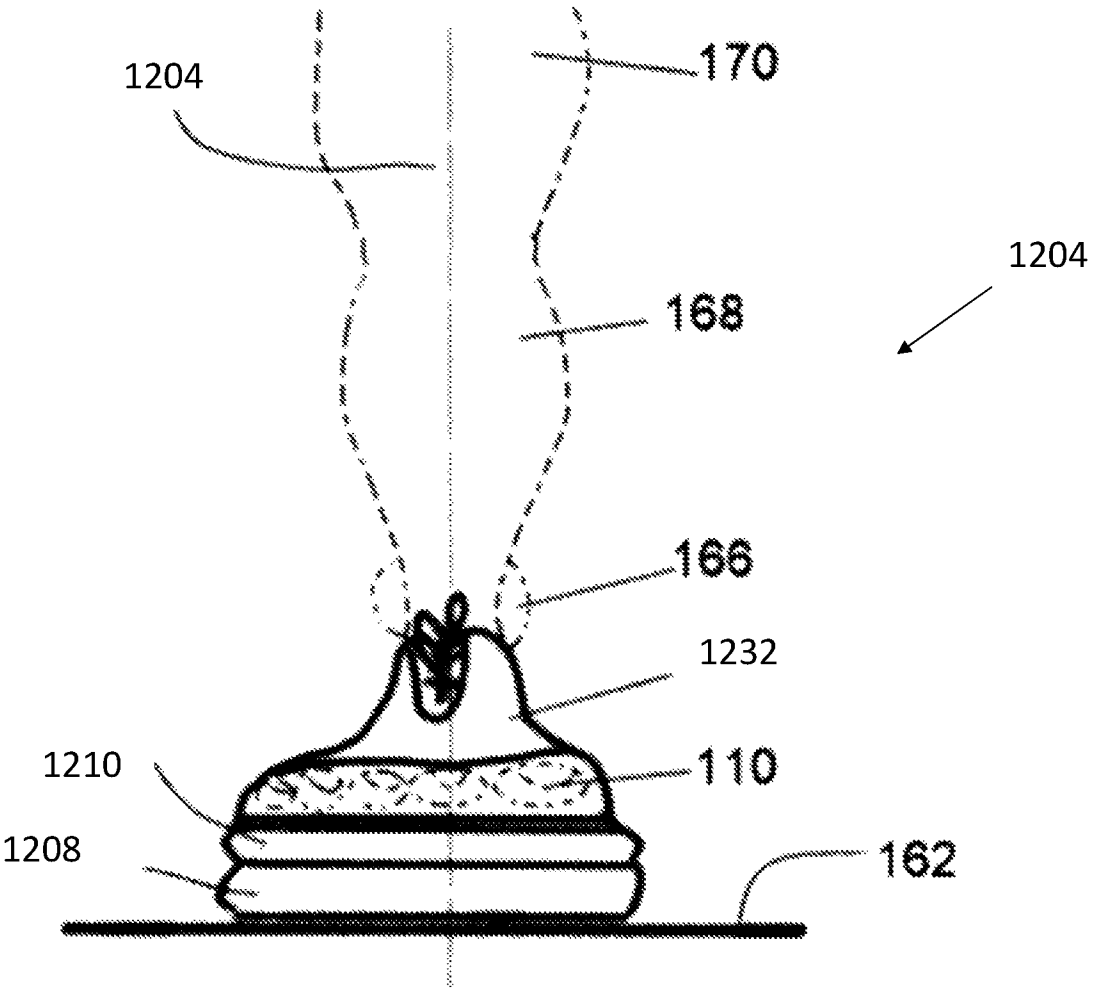
FIG. 12 is an illustration of a front view of a prior art athletic shoe while standing straight vertically.

FIG. 12 is an illustration of a front view of a prior art athletic shoe 1200 while standing straight vertically. The figure includes a depiction of a lower leg and ankle 166 situated as if they are connected to a foot 164 wearing the shoe.

FIG. 12 shows frontal cross-sectional view through the toe box 1202 of prior art and a medial line 1204 indicating the relationship of the prior art athletic shoe 1200, shoe sole 1208, toes 110, foot 164, ankle 166, and lower leg 168. While standing normally, the toes 110, foot 164, ankle 166, and lower leg 168 are appropriately situated along the medial line 1204. The prior art athletic shoe 1200, when standing normally, has the entire sole 1208 resting against the ground 162.

Figure 13:
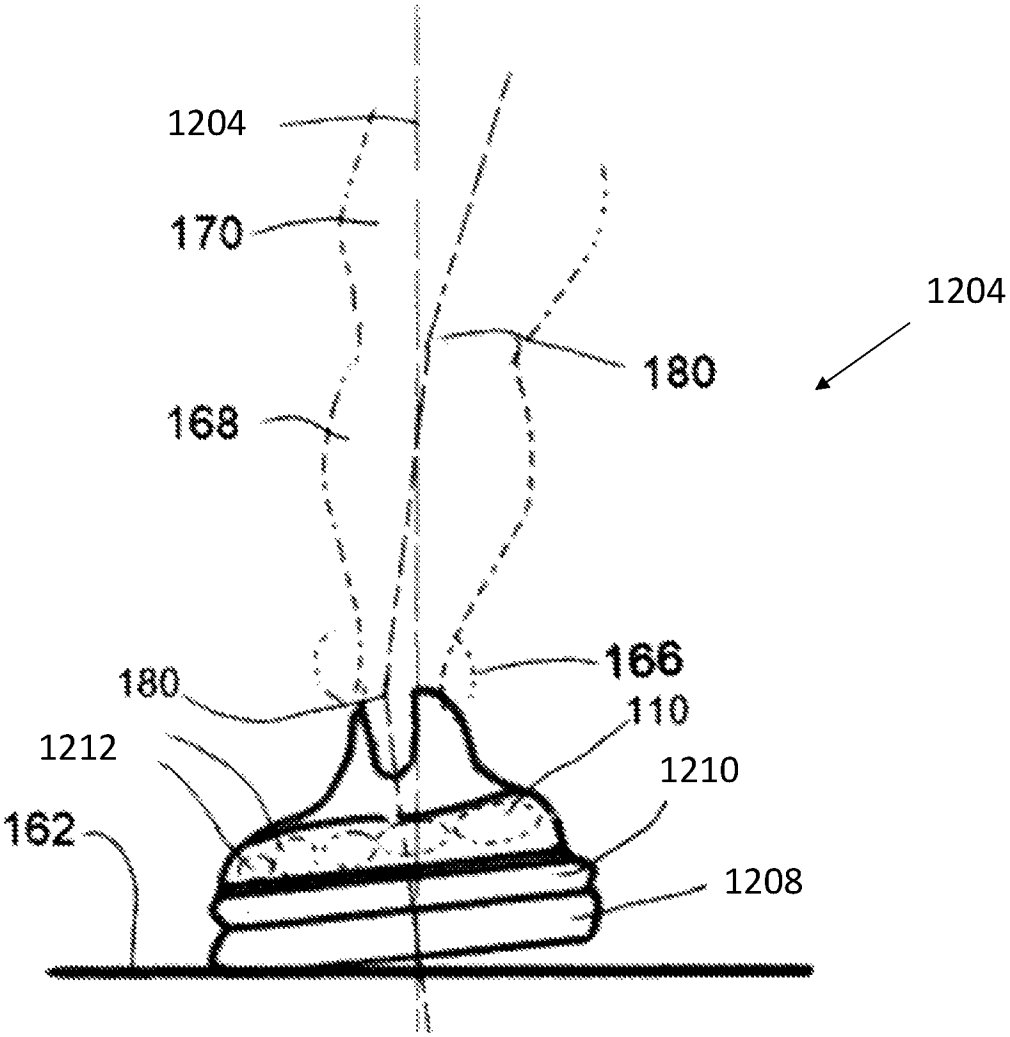
FIG. 13 is an illustration of a front view of a prior art athletic shoe while in a small sidestep.

FIG. 13 is an illustration of a front view of a prior art athletic shoe 1200 while in a small sidestep. The drawing illustrates the medial side 1204 of the shoe 1200 losing traction and contact with the ground 162. The foot 164, including the toes 110 and 123, and the ankle 166 and lower leg 168, deviate from the medial line 1204 starting to form an angle 180. As the medial side 1204 of the sole 1208 lifts from the ground 162, the ankle 166 extends away from the medial line 1204 towards an exterior side 1304 of the shoe 1206. This is an early stage of rolling of the ankle 166; the shoe 1206 and foot 164 rotate around the medial line 1204 of the shoe 1206 causing the foot 164 to lose contact with the sole 1208 on the medial side 1204 of the shoe 1206 as the shoe 1206 loses contact with the sole 1208 on the medial side 1204 of the shoe 1206, the ankle 166 and the lower leg 170 begin to create a dangerous angle 180 with the foot 164. This angle 180, can put the ankle 166 at risk for injury such as a fracture or a sprain.

Figure 14:
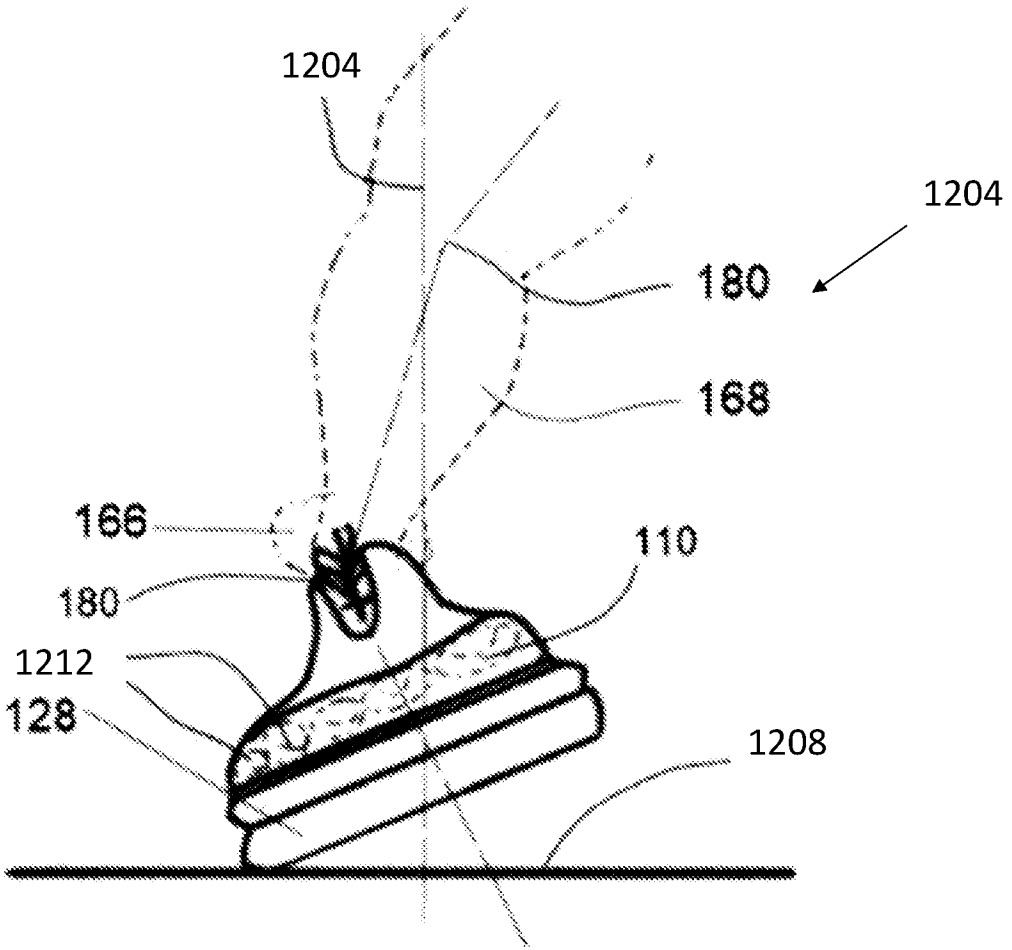
FIG. 14 is an illustration of a front view of a prior art athletic shoe while rolling the ankle.

FIG. 14 is an illustration of a front view of a prior art athletic shoe 1200 while rolling the ankle 166. Within FIG. 14, the ankle 166 experiences a more severe of roll of the ankle 166 shown by a larger angle 180 created between the ankle 166 and the lower leg 168 and the foot 164. As the angle 180 increases, the distance between the medial side 1204 of the sole 1208 increases. Additionally, the distance between the hallux 110 of the foot 164 and the sole 1208 increases separating the medial side 1204 of the foot 164 from the sole 1208. Alternative injuries can occur when the ankle 166 rolls towards the medial side 1204 of the shoe, causing the toes 123 to lift from the sole 1208 and the sole 1208 on the lateral side 1206 to separate from the ground 162.

Figure 15:
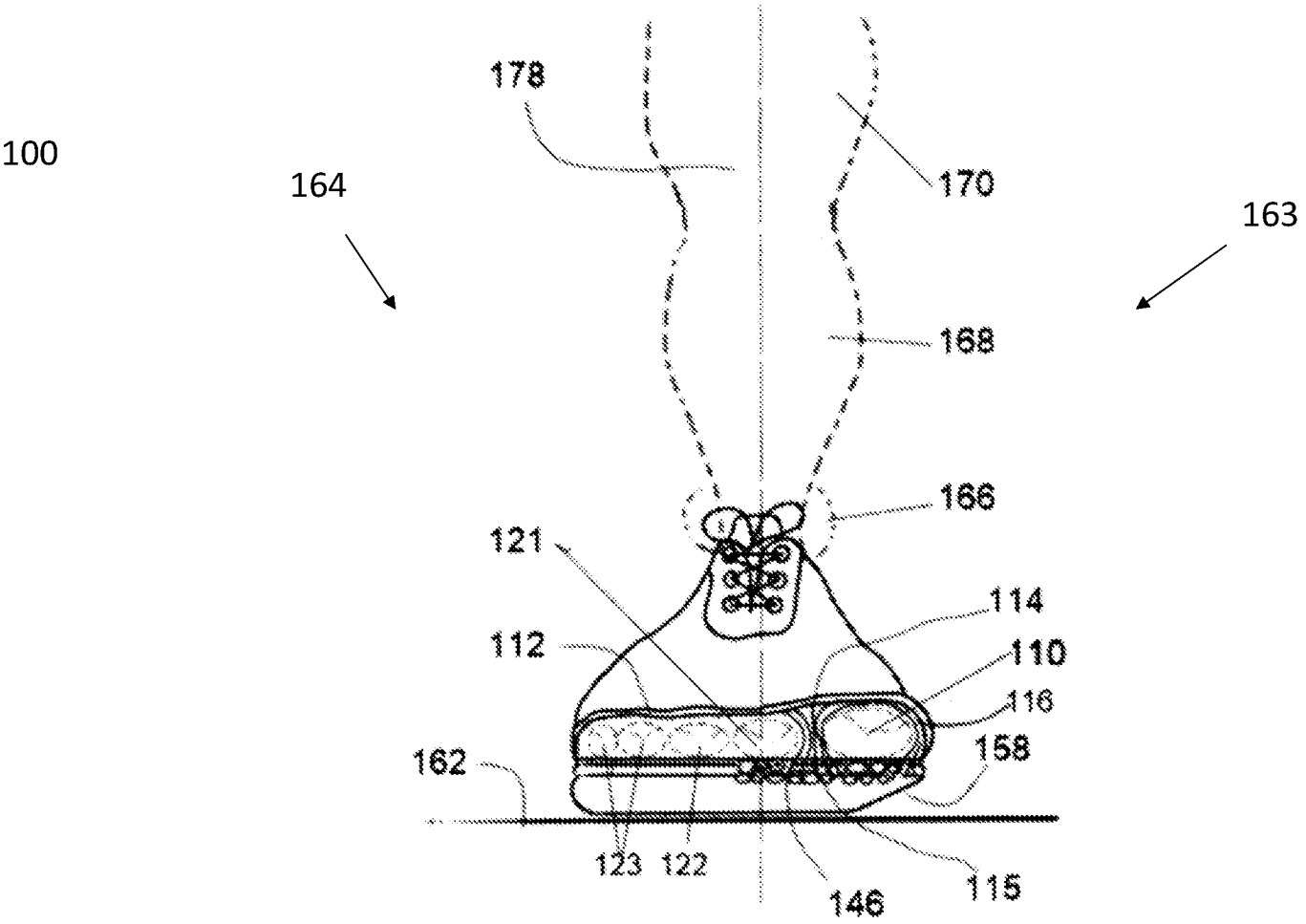
FIG. 15 is an illustration of a front view through the toe box of an anatomically pliant athletic shoe while standing straight vertically.
Figure 16:
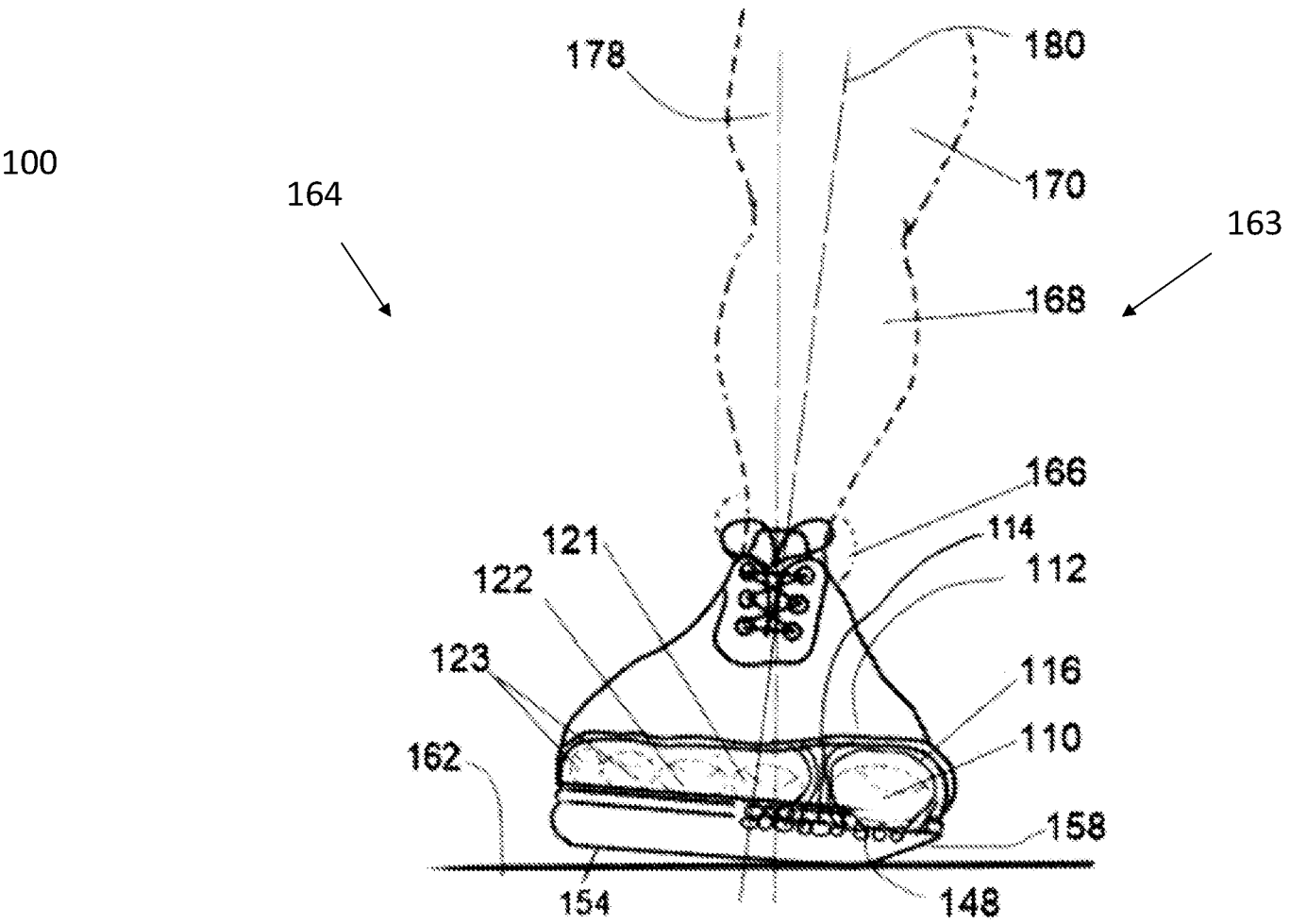
FIG. 16 is an illustration of a right anatomically pliant athletic shoe engaged in a small sidestep.
Figure 17:
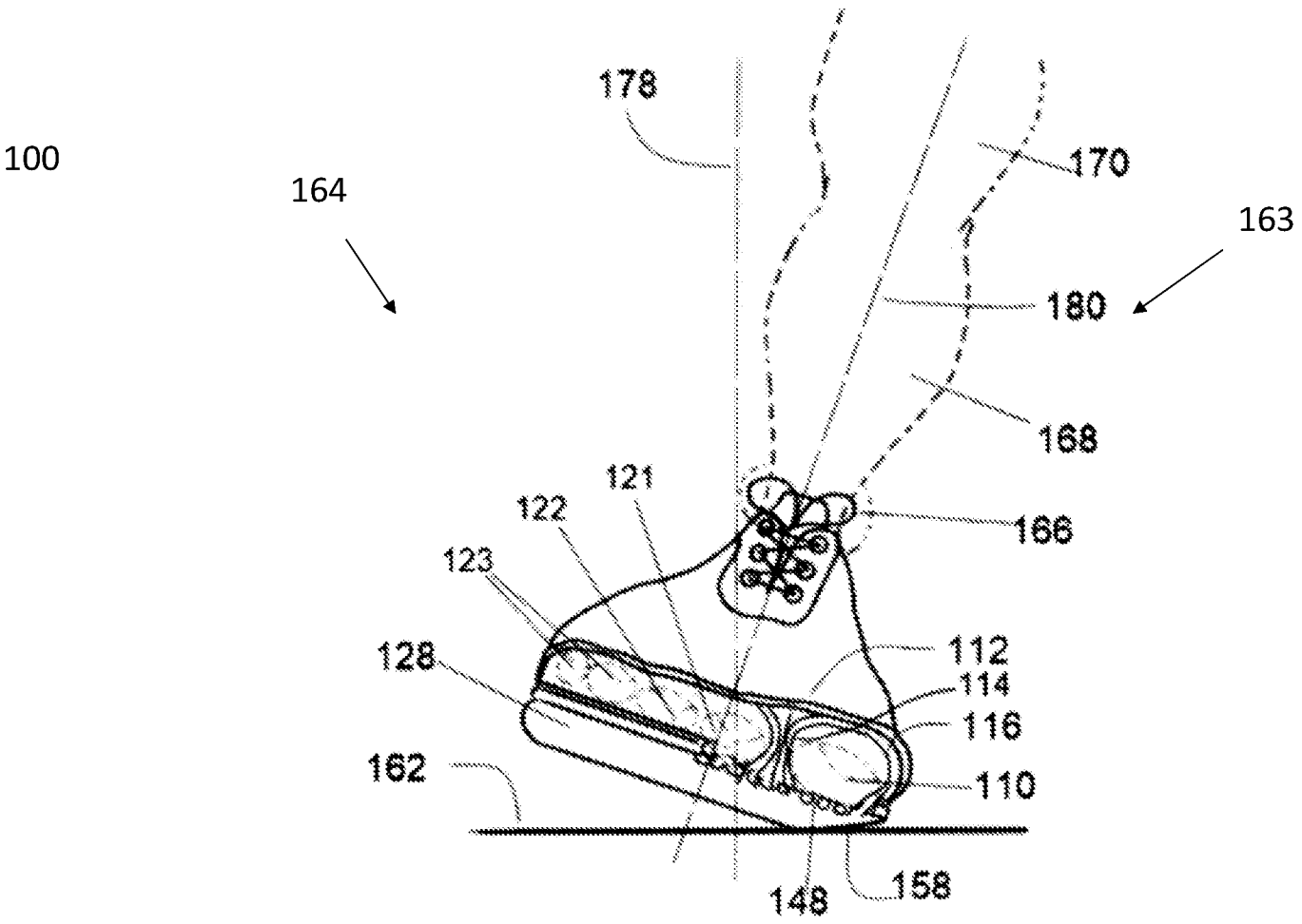
FIG. 17 is an illustration of a right anatomically pliant athletic shoe engaged in a larger sidestep.

FIGS. 15-17 show cross-sectional schematic drawings through the toe box 112 of the anatomically pliant athletic shoe 100 in use. FIGS. 15-17 illustrate the effect using the shoe 100 has on the toes 110, 122, and 123, foot 164, ankle 166, and lower leg 168.

FIG. 15 is an illustration of a front view through the toe box 112 of an anatomically pliant athletic shoe 100 while standing straight vertically. The foot 164, ankle 166, and lower leg 168 are all stacked along a medial line 1500. When standing normally, the angled section 158 of the outsole 128, does not rest along the ground 162 while the rest of a bottom surface of the outsole 128 rests flat along the ground 162. Within the anatomically pliant athletic shoe 100, the toe post 111 extends vertically towards the ankle 166 from the soles 129 between the hallux 110 and the toes 121. The compressible area 146 below only the hallux 110 and the second toe 121 has minimal compression along the medial side 163 of the anatomically pliant athletic shoe 100.

FIG. 16 is an illustration of a right anatomically pliant athletic shoe 100 engaged in a small sidestep. The toe post 111 and the toe strap 114 work in tandem to keep the hallux 110 in contact with the insole 126 of the anatomically pliant athletic shoe 100. As the small step is taken, the soles 129 along the lateral side 165 lose contact with the ground 162 and the angled section 158 begins to have contact with the ground 162 at the junction point 160 from FIG. 9. The compressible area 146 near the medial side 163 begins to compress as more pressure from the foot 164 is exerted on it. The compression of the compressible area 146, the angled section 158, and the toe post 111 and toe strap 114 all work in tandem to keep the foot 164, ankle 166, and lower leg 168 straight along the medial line 1500. Unlike the prior art athletic shoe 1200 in FIGS. 13 and 14, the anatomically pliant athletic shoe 100 prevents the dangerous angle 180 from being formed that can cause injuries. In some embodiments, the angled section 158 can be angled according to the wearer. For example, the angled section 158 can vary with the weight of the wearer, individual anatomical structure, walking patterns, or other personal factors. In some embodiments, the left and right anatomically pliant athletic shoes 100 for a single wearer may be different to best suit the wearer and provide the optimal amount of support. For example, activities such as baseball where the baserunner usually runs counterclockwise, the angled portion can be on the medial of the right shoe and the lateral surface of the left shoe. In some embodiments, the compressibility of the compressible area 146, may vary to fit the weight and/or strength of the wearer.

FIG. 17 is an illustration of a right anatomically pliant athletic shoe 100 engaged in a larger sidestep. The hallux 110 and the second toe 121 use the toe post 111 and toe strap 114 to prevent the foot 164 from sliding inside the anatomically pliant athletic shoe 100, thus maintaining the mesial-distal position of the foot 164 in the anatomically pliant athletic shoe 100. As the hallux 110, the second toe 121 and corresponding metatarsal section (not pictured) of the foot 164 press into the compressible area 148 of the soles 129; the third 122, fourth 123 and fifth 123 toes rotate superiorly; thus, the sole of the foot 164 and the bottom surface 154 of the outer sole 128 are on different planes. As the hallux 110, second toe 121 and corresponding metatarsal section of the foot 164 compress into the compressible area 146 of the soles 129, the angled section 158 of the outsole 128 is engaged with the ground 162. The foot 164, ankle 166, lower leg 168, and upper leg 170 maintains a physiologically ideal relationship to avoid rolling of the ankle 166 and creating the dangerous angle 180 created by the prior art shoe 1200 in FIGS. 13 and 14. The lower extremities determine how the anatomically pliant athletic shoe 100 will move, based on the movement of the foot 164; not the shoe determining the manner in which the lower extremities function. To prevent rolling the ankle 166 towards the lateral side 165 and causing injury, the anatomically pliant athletic shoe 100 may further include an angled section 158 along the lateral side 165 of the outsole 128 under the fourth and fifth toes 123. In some embodiments, a pair of shoes may be customized such that the angled section 158 and the compressible area 146 do not have to be on the same side of the left and right shoe.

Figure 18:
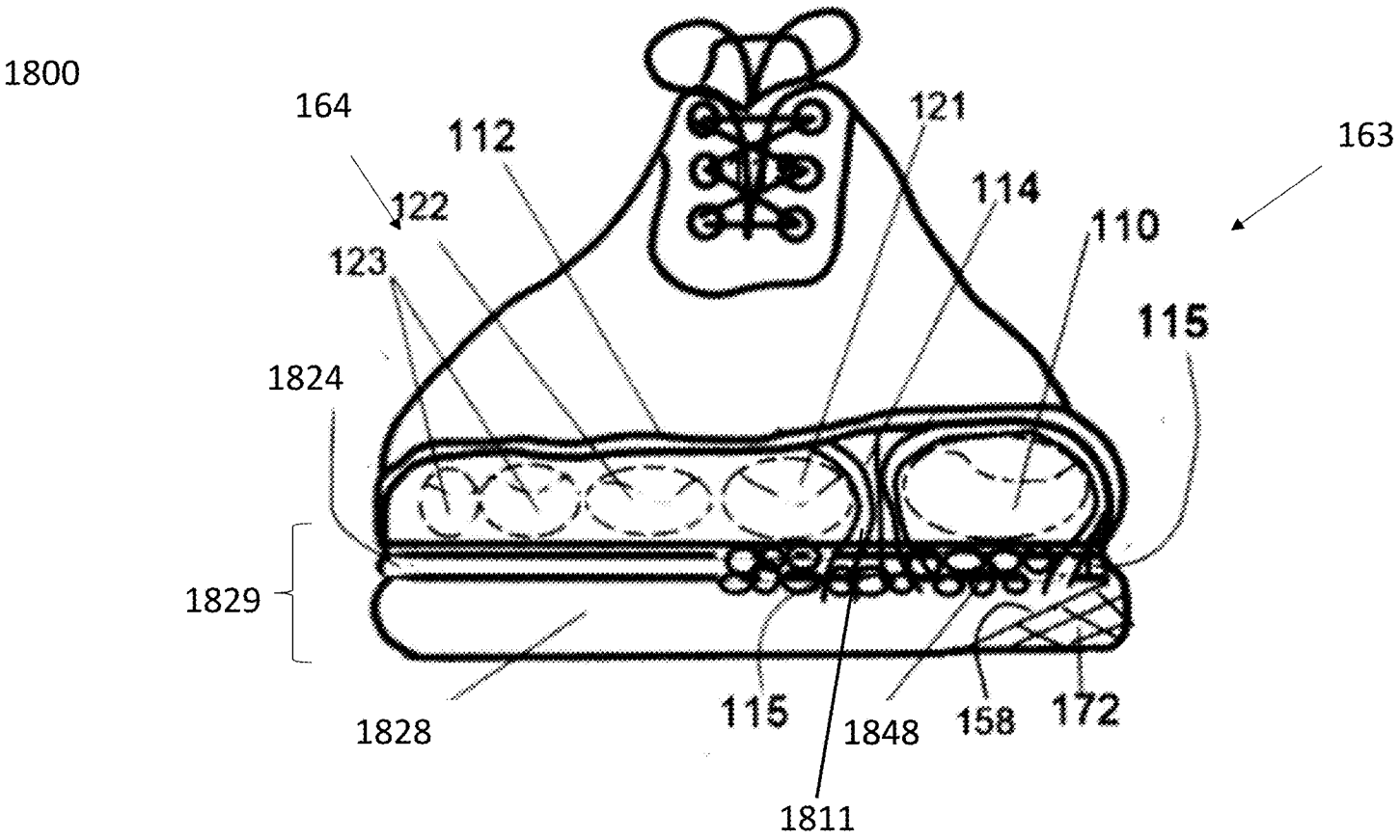
FIG. 18 is an illustration of a right anatomically pliant athletic shoe with additional compressible area standing vertically.

Another is illustrated in embodiment in FIG. 18 is an illustration of a right anatomically pliant athletic shoe 1800 with additional compressible area 172 standing vertically. In some embodiments, the anatomically pliant athletic shoe 1800 utilizes a functional angle comprising a more compressible area 172 of the outsole 1828 such that more compressible area 172, when engaged, will perform similar to the angled area 158 as seen, for example, in FIG. 15. The toe post 1811, toe strap 1814, and the compressible area 1848 of the soles 1829 of the anatomically pliant athletic shoe 1800 are functionally similar to the toe post 111, toe strap 114, and the compressible area 1848 of the anatomically pliant athletic shoe 100. However, the angled section 158 of the anatomically pliant athletic shoe 100, for example, in FIG. 15, is replaced by the more compressible area 172 of the outsole 128. When forces are applied to the more compressible area 172, the more compressible area 172 compresses and becomes a similar shape to the angled section 158 of the outsole 128 of the anatomically pliant athletic shoe 100. The more compressible area 172 functions similarly to the angled section 158 to prevent injuries to the ankle 166 as seen in FIG. 15. In some embodiments, the more compressible area 172 of the outsole 128 can be fabricated with low density materials, pneumatic systems, or hydraulic systems. In some embodiments, the more compressible area of the sole can be on the lateral side 165 of the anatomically pliant athletic shoe 1800 below the fifth, fourth toe and its corresponding metatarsal bone.

Figure 19:
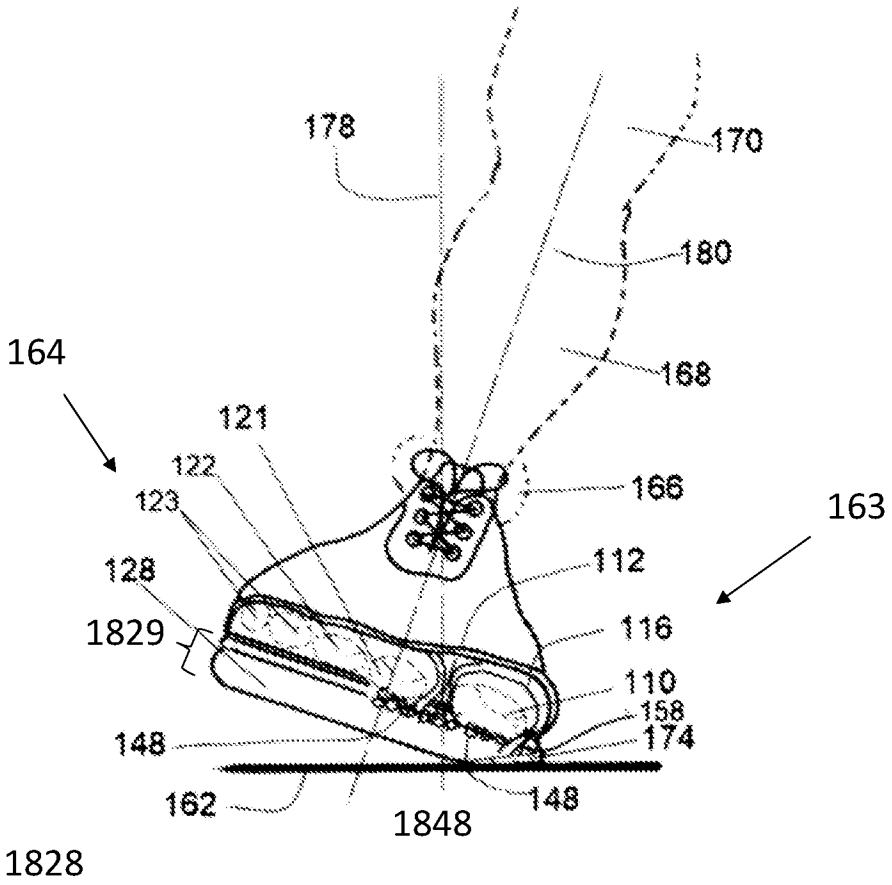
FIG. 19 is a simplified schematic drawing of the additional embodiment of FIG. 18 inside stepping.

FIG. 19 is a simplified schematic drawing of the additional embodiment of FIG. 18 inside stepping. The hallux 110 and the second toe 121 use the toe post 111 and toe strap 114 to prevent the foot 164 from sliding inside the anatomically pliant athletic shoe 100, thus maintaining the mesial-distal position of the foot 164 in the anatomically pliant athletic shoe 100. As the hallux 110 and the second toe 121 toes and corresponding metatarsal section (not pictured) of the foot 164 press into the compressible area 148 of the soles 129; the third 122, fourth 123 and fifth 123 toes rotate superiorly; thus, the sole of the foot 164 and the bottom surface 154 of the outer sole 128 are on different planes. Additionally, the more compressible area 172 of FIG. 18 is depicted as being compressed by the inside stepping and is a compressed more compressible area 174. As the hallux 110, second toe 121 and corresponding metatarsal section of the foot 164 compress into the compressible area 146 of the soles 129 and the inside of the foot 164 including the inside of the hallux 110 compress the more compressible area 172 to a compressed more compressible area 174, the compressed more compressible area 174 compresses to maintain proper alignment. The foot 164, ankle 166, lower leg 168, and upper leg 170 maintains a physiologically ideal relationship to avoid rolling of the ankle 166 and creating the dangerous angle 180 created by the prior art shoe 1200 in FIGS. 13 and 14. The lower extremities determine how the anatomically pliant athletic shoe 100 will move, based on the movement of the foot 164; not the shoe determining the manner in which the lower extremities function. To prevent rolling the ankle 166 towards the lateral side 165 and causing injury, the anatomically pliant athletic shoe 100 may further include an angled section 158 along the lateral side 165 of the outsole 128 under the fourth and fifth toes 123. In some embodiments, a pair of shoes may be customized such that the angled section 158 that angles along the more compressible area 172 of FIG. 18 and the compressible area 146 do not have to be on the same side of the left and right shoe.

In some embodiments, the anatomically pliant athletic shoe can include two angled sections of compressible area, one along the medial side and one along the lateral side. In such embodiments, the two compressible areas do not connect, but create a pliant portion on both sides of the foot that allow the foot to move more naturally in additional directions.

The description of the embodiments depicted in these drawings is for illustrative purposes only. The disclosed embodiments are examples of some variations of the invention, which may be embodied in various forms. The present disclosure is not meant to be limiting, and it should be recognized that any variation within the spirit of this disclosure is intended to be enveloped within the scope of the disclosure. The simplified schematic drawings are used to best illustrate some embodiments an anatomically pliant athletic shoe 100, and how they interact to achieve the desired result. The drawings do not represent the actual or relative sizes, proportions, or positions of the embodiments, for they will vary according to user and its application.

What is claimed is:

1. An anatomically pliant athletic shoe, comprising:

a sole comprising:

a bottom surface;

a top surface positioned opposite the bottom surface;

a lateral edge;

a medial edge positioned opposite the lateral edge;

a first compressible area adjacent to the top surface of the sole and above the bottom surface which extends from the medial edge and ends at a midway point between the medial edge and the lateral edge; and a second compressible area of the sole which extends under a portion of a forefoot portion, the second compressible area positioned below the first compressible area, the second compressible area comprising an upper edge positioned at the medial edge and adjacent to the first compressible area and a bottom edge positioned a first distance towards the midway point from the medial edge and adjacent to the bottom surface such that the second compressible area extends at an angle diagonally downward from the upper edge towards the bottom edge wherein at least a portion of the second compressible area has a triangular cross-section, wherein the second compressible area is more compressible than the first compressible area, and the first compressible area is more compressible than remaining portions of the sole;

a toe box connected to the top surface of the sole;

a toe post protruding from the top surface of the sole to a surface of the toe box, the toe post positioned between a hallux portion and a small toe portion of the toe box; and a toe strap positioned within the hallux portion of the toe box and anchored to the top surface of the sole, wherein the midway point is lateral from the toe post and the toe strap and the second compressible area is positioned medial from the toe post and the toe strap.

2. The anatomically pliant athletic shoe of claim 1, wherein the compressibility of the first compressible area is not uniform throughout the first compressible area.

3. The anatomically pliant athletic shoe of claim 1, wherein the midway point is positioned adjacent a second toe portion of the toe box.

4. The anatomically pliant athletic shoe of claim 1, wherein the midway point is positioned between a second toe portion and a third toe portion of the toe box.

5. The anatomically pliant athletic shoe of claim 1, wherein the toe strap is configured to circumscribe a hallux toe.

6. The anatomically pliant athletic shoe of claim 1, wherein the second compressible area connects the bottom surface with the first compressible area on the medial edge.

7. The anatomically pliant athletic shoe of claim 1, wherein the second compressible area extends along the bottom surface of the sole and ends beneath a second toe portion of the small toe portion of the toe box.

8. The anatomically pliant athletic shoe of claim 7, wherein the angle of the second compressible area is 15° or greater.

9. The anatomically pliant athletic shoe of claim 7, wherein the angle of the second compressible area is 45° or less.

10. The anatomically pliant athletic shoe of claim 7, wherein the angle of the second compressible area is 5°, 10°, 15°, 20°, 25°, 30°, 35°, 40°, 45°, 50°, 55°, 60°, 65°, 70°, 75°, 80°, or 85°.

11. The anatomically pliant athletic shoe of claim 1, wherein the second compressible area runs along a length of the medial edge.

12. The anatomically pliant athletic shoe of claim 1, wherein the second compressible area runs along a portion of a length of the medial edge.

13. The anatomically pliant athletic shoe of claim 1, wherein the second compressible area runs along 50% or greater of a length of the medial edge.

14. The anatomically pliant athletic shoe of claim 1, wherein the second compressible area runs along 50%, 60%, 70%, 75%, 80%, or 90% of a length of the medial edge.

15. The anatomically pliant athletic shoe of claim 1, wherein the second compressible area runs along a forefoot portion of a length of the medial edge.

16. The anatomically pliant athletic shoe of claim 1, wherein the second compressible area comprises a low density material.

17. The anatomically pliant athletic shoe of claim 1, wherein the first compressible area comprises natural materials, synthetic materials, fabricated or engineered material.

18. The anatomically pliant athletic shoe of claim 1, wherein the toe post comprises a circular or ovoid column.

19. The anatomically pliant athletic shoe of claim 1, wherein the toe strap is attached to the toe post.

20. The anatomically pliant athletic shoe of claim 1, wherein the first compressible area tapers as it extends away from the medial edge.

* * * * *